US009027293B1

(12) United States Patent
Scott

(10) Patent No.: US 9,027,293 B1
(45) Date of Patent: May 12, 2015

(54) WINDOW COVERING SYSTEM

(71) Applicant: Richard Scott, Indianapolis, IN (US)

(72) Inventor: Richard Scott, Indianapolis, IN (US)

( * ) Notice: Subject to any disclaimer, the term of this patent is extended or adjusted under 35 U.S.C. 154(b) by 0 days.

(21) Appl. No.: 14/057,636

(22) Filed: Oct. 18, 2013

(51) Int. Cl.
*E06B 3/26* (2006.01)
*E06B 9/02* (2006.01)

(52) U.S. Cl.
CPC ..... *E06B 9/02* (2013.01)

(58) Field of Classification Search
CPC ..... E04B 3/26
USPC ..... 52/202, 203, 208, 506.01, 506.05, 52/506.06, 127.8, 204.62, 204.64, 204.65, 52/204.66, 204.69, 656.1, 656.2, 656.7; 428/174, 34.1, 99, 425.6; 49/50, 57, 49/463, 465–466, 475.1, 489.1, 449; 292/341.15, 137, 163, 32; 160/368.1
See application file for complete search history.

(56) References Cited

U.S. PATENT DOCUMENTS

| | | | | |
|---|---|---|---|---|
| 3,799,817 | A * | 3/1974 | Van Laethem | 216/34 |
| 3,806,400 | A * | 4/1974 | Laethem | 52/223.1 |
| 3,872,804 | A * | 3/1975 | Yarnall | 109/49.5 |
| 4,067,154 | A * | 1/1978 | Fike, Jr. | 52/99 |
| 5,468,559 | A * | 11/1995 | Solinov et al. | 428/410 |
| 5,918,430 | A * | 7/1999 | Rowland | 52/202 |
| 6,681,533 | B1 * | 1/2004 | Doyle | 52/107 |
| 6,737,151 | B1 * | 5/2004 | Smith | 428/192 |
| 7,214,433 | B2 * | 5/2007 | Wong et al. | 428/441 |
| 2002/0184839 | A1 * | 12/2002 | Emek | 52/202 |
| 2006/0086057 | A1 * | 4/2006 | Rasenberger et al. | 52/202 |
| 2012/0219749 | A1 * | 8/2012 | Leighton et al. | 428/76 |

* cited by examiner

*Primary Examiner* — Beth Stephan
(74) *Attorney, Agent, or Firm* — Brannon Sowers & Cracraft; C John Brannon

(57) ABSTRACT

A window covering assembly, including a generally convex panel defining a perimeter. The panel further includes structural outer and inner layers and an impact absorbing layer disposed between the structural outer layer and the structural inner layer. A flange portion is connected to the generally convex panel and has a plurality of apertures formed therethrough. A plurality of fasteners are extendable through the apertures for engaging a structure.

8 Claims, 9 Drawing Sheets

WINDOW COVERING SYSTEM

TECHNICAL FIELD OF THE INVENTION

The present invention relates generally to home improvement construction, and, more particularly, to a layered convex covering device and methods for using the same to provide window security against weather damage and intrusion.

BACKGROUND OF THE INVENTION

High winds from severe weather can cause serious damage to structures. Tornados, hurricanes, microbursts and the like can yield high winds that may propel hail and/or objects into buildings at high speeds, resulting in substantial damage. The parts of buildings most vulnerable to projectile impacts are the glass windows. When broken by wind-driven projectiles (or merely by the winds themselves), glass and other debris may be propelled into the building, causing substantial damage. Further, the building is now open to the elements, which can cause additional damage, and to animals and/or unauthorized individuals. Likewise, even in the absence of foul weather, windows are the obvious access point for individuals desiring to break into a building. Both of these problems are compounded when the building is vacant for extended periods of time, such as homes during vacations, summer homes in the non-summer months, homes and businesses for rent, and the like.

Storm shutters are one traditional method of buttressing windows. Storm shutters are traditionally engaged over the windows, and do add some level of protection. However, as most storm shutters are hingedly connected to the building exterior and engaged by latching, if the latch malfunctions, the storm shutters are free to pivot in the wind, and can cause substantial damage on their own. Further, storm shutters are typically made of lightweight structural material and thus provide limited protection in the event of serious weather.

Another typical approach to storm-proofing windows is to nail plywood or even thicker boards to the exterior structure to provide reinforcement. This technique is somewhat effective if sufficient advance warning to extreme weather is available, but requires nailing or otherwise securing the boards directly to the building exterior, causing damage thereto. Upon the removal of the boards, the building exterior must be repaired.

Pre-fabricated security coverings are also available, such as bars, screens, and plates, but these also have their disadvantages. Bars and screens are effective at retarding penetration by intruders, but are less affective at preventing wind damage, as wind can pass through bars and screens. Metal plates are effective at repelling both intruders and weather, but tend to be heavy, and may also be dented or bent by impacts. Further, none of these methods is particularly effective at stopping small, fast moving projectiles, whether they be bullets or weather-driven pieces of wood. Thus, there remains a need for an improved window covering for preventing storm damage and ingress by intruders. The present invention addresses this need.

SUMMARY

The present novel technology relates to layered protective window covering. One object of the present invention is to provide an improved method and device for protecting a window. Related objects and advantages of the present invention will be apparent from the following description.

DETAILED DESCRIPTION OF THE PREFERRED EMBODIMENTS

Figure 1:
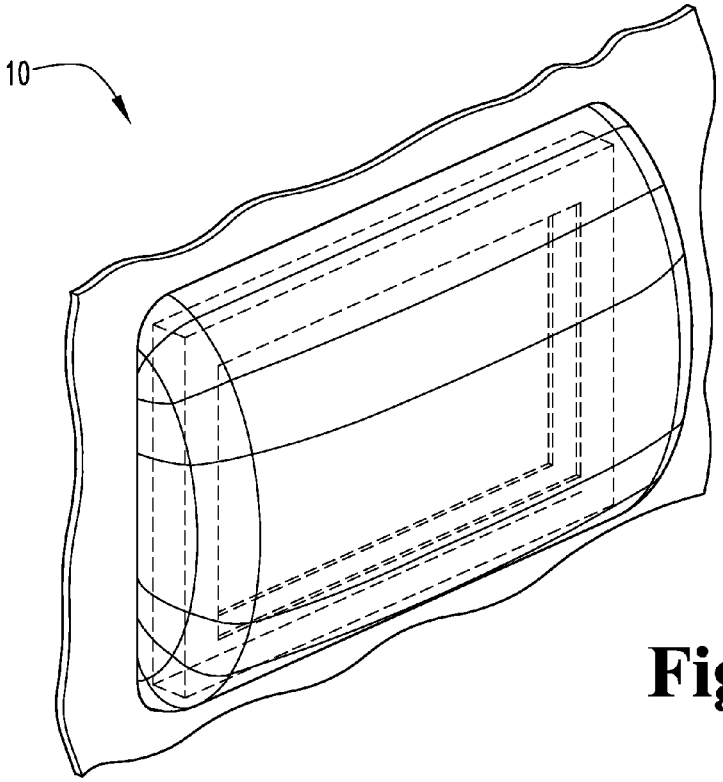
FIG. 1 is a perspective view of a first embodiment convex window covering assembly of the present invention.
Figure 2:
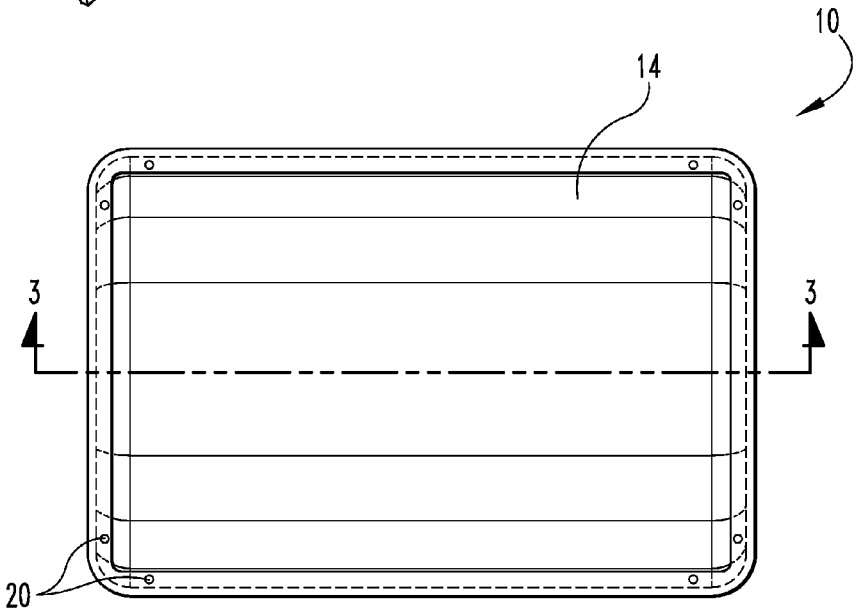
FIG. 2 is a bottom plan view of the embodiment of FIG. 1.
Figure 3:
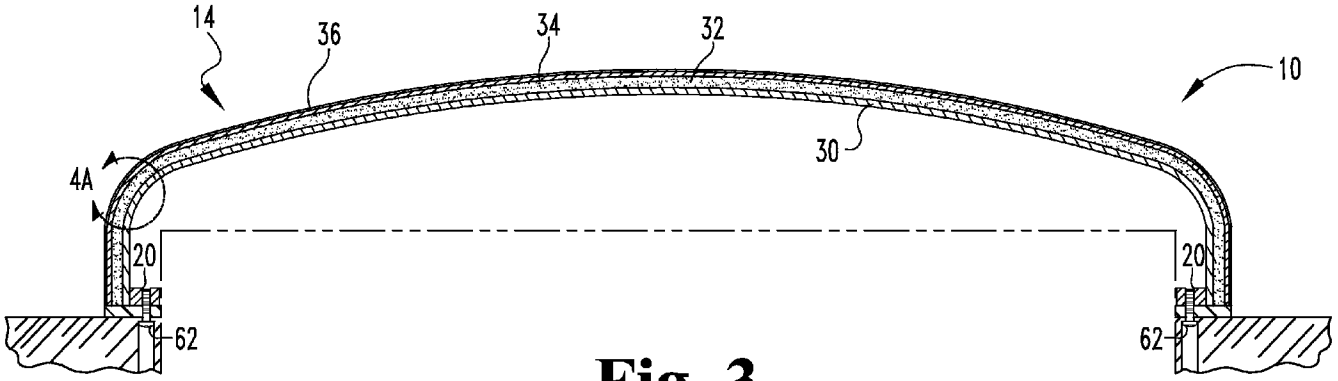
FIG. 3 is a partial side cutaway elevation view of the embodiment of FIG. 1.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

FIGS. 1-4A and 6 relate to a first embodiment of the present invention, a convex window covering system 10 including a generally rectangular flange portion 12 connected to a generally convex structural member (or panel or shell) 14. In this embodiment, the generally convex structural member 14 completely covers the flange portion 12, such that the flange portion 12 is generally inaccessible from the outside; in other embodiments, the flange portion may extend beyond the generally convex structural member 14.

Figure 7A:
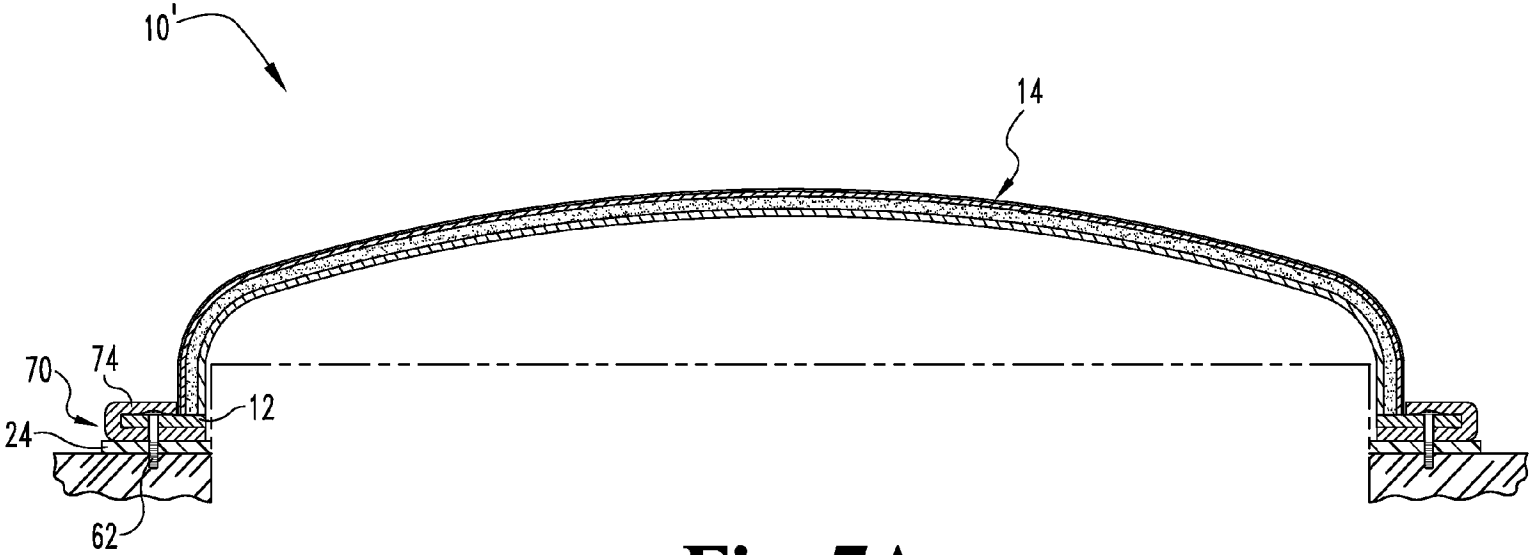
FIG. 7A is a partial side cutaway elevation view of a second embodiment convex window covering assembly and including a security member of the present invention.

The generally rectangular flange portion 12 typically includes a plurality of pre-formed apertures 20 extending therethrough for connecting to the exterior wall of a structure. Typically, the flange portion 12 is sized to fit over an existing window, and more typically the apertures 20 are spaced and arranged to match existing fastener holes. However, the apertures 20 need not be preformed, and preformed apertures 20 likewise need not match up with existing fastener holes. As shown in the embodiment of FIG. 7A, the flange portion 12 may further include a seal member 24 connected thereto for sealingly engaging the exterior wall of a structure to restrict the flow of moisture and fluids.

The structural member 14 is typically convex, so as to present a 'turtle-shell' appearance extending from an exterior wall when engaged thereto, although it may be of other geometries, such as generally flat or the like. The structural member 14 is typically layered, having a structural inner layer 30, an impact absorbing and/or attenuating layer 32 positioned radially outward from and typically adjacent to the structural inner layer 30, and a structural outer layer 34 positioned radially outward from and typically adjacent to the impact absorbing and/or attenuating layer 32. A generally weather resistant and decorative outer layer 36, such as a thin plastic coating, may be applied if desired. The structural member 14 is typically transparent or at least translucent, although it may be opaque. The structural member 14 is typically formed from a tough material, such as a high grade polycarbonate resin thermoplastic, tempered glass, composite, ceramic, cermet, or metal, but may alternately be made of other like materials.

Figure 4A:
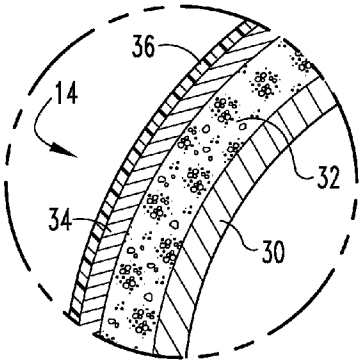
FIG. 4A is an enlarged cutaway view of a section of FIG. 3.
Figures 4B, 4C:
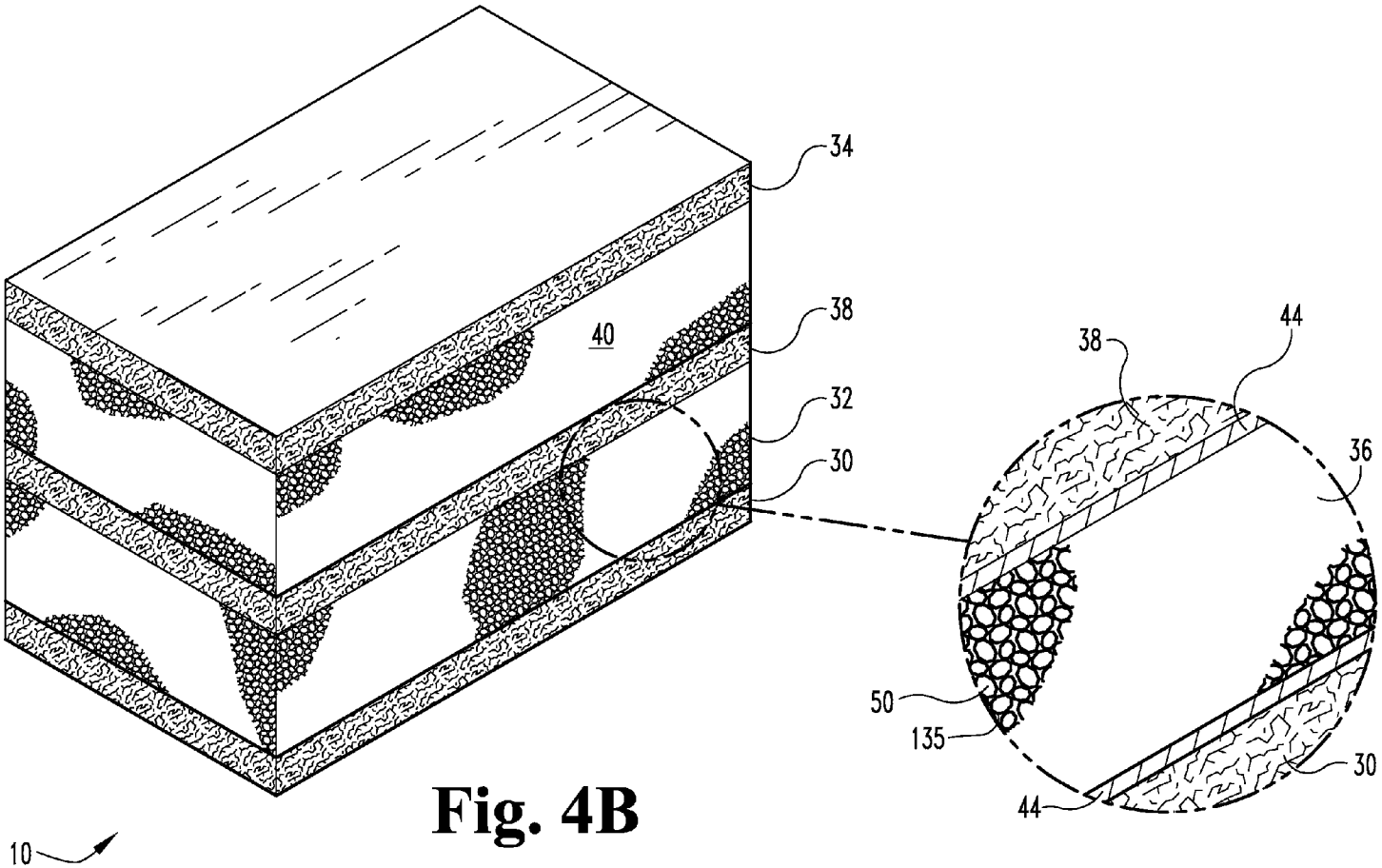
FIG. 4B is an enlarged cutaway view of a section of a first alternative embodiment of FIG. 3.
FIG. 4C is an enlarged partial view of a section of FIG. 4B.
Figure 6:
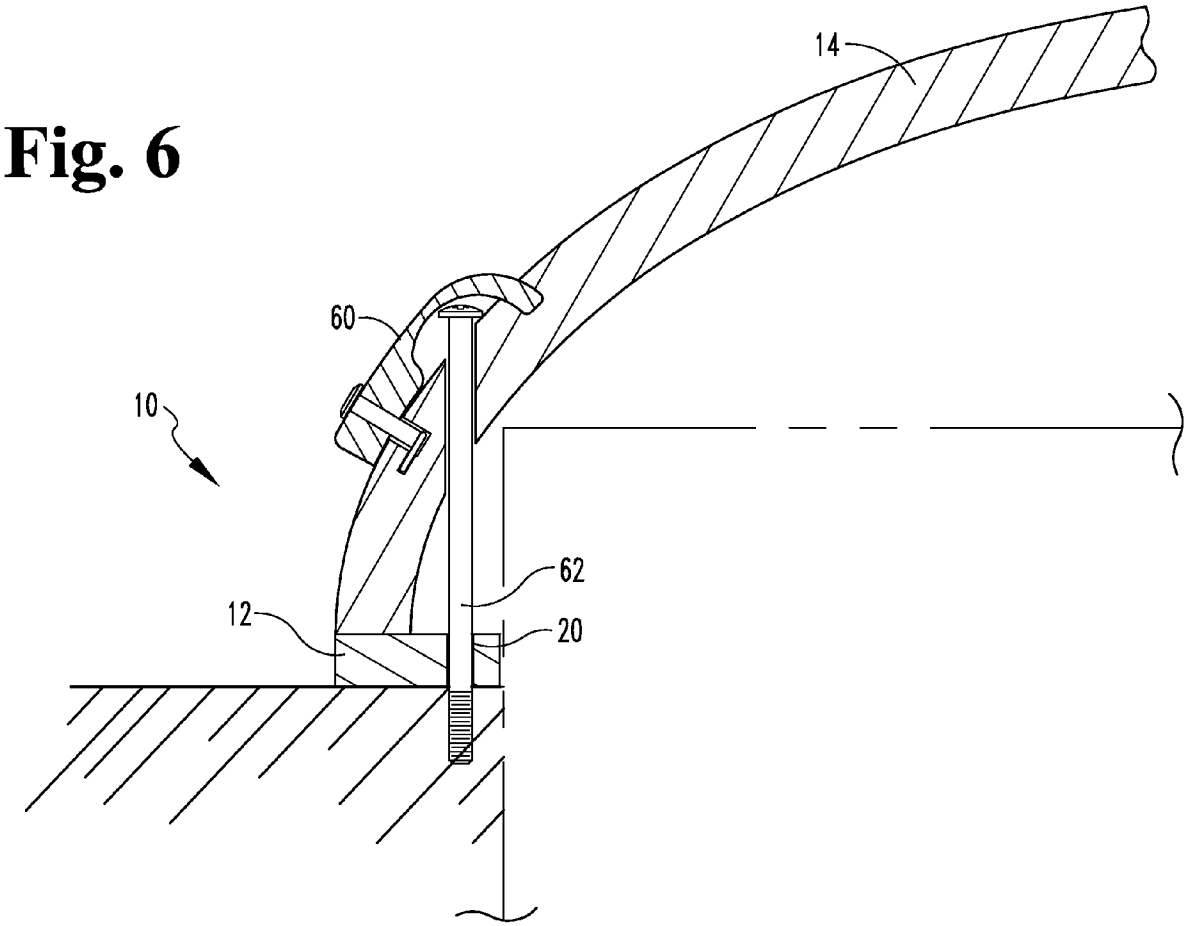
FIG. 6 is an enlarged partial cutaway view of a fastener extending through the convex window covering assembly of claim 1 and covered with a cover plate.

Referring to FIG. 4B, additional layers of structural and impact resistant materials are added. In addition to the above mentioned layers 30, 32, 34, additional structural layer 38 is positioned between impact absorbing and/or attenuating layer 32 and structural outer layer 34, with additional impact absorbing and/or attenuating layer 40 positioned between structural layer 38 and structural outer layer 34. As is illustrated in FIG. 4C, alternating layers of structural and impact absorbing material (such as layers 30, 36 and/or 36, 38) are often bonded by a thin adhesive layer 44.

The structural material, such as defining structural layers 30 and 34 may be sheet metal, spun para-aramid synthetic fiber, fiber-reinforced composites, plastic, fiberglass or the like. Typically, the innermost and outermost structural layers 30, 34 are made of sheet metal, while the inner layers 38 are typically made of tough but flexible structural materials such as spun para-aramid synthetic fiber, fiber-reinforced composites, plastic, fiberglass, or the like. The impact absorbing/attenuating layers 32, 40 are typically made of foamed materials such as open-celled polymer foamed polymers, closed-cell foamed polymers, foamed glass, and rockwool. Typically, the impact absorbing/attenuating layers absorb kinetic energy, such as from blunt force or projectile impacts, by deforming. Such materials are typically defined by a plurality of interior cells 50 which, in this case, are deformable. In the case of most foamed polymers, such deformation is followed by a complete or near-complete return to the original shape. In the case of foamed glass or rockwool layers, the kinetic energy is dissipated through the breakage of individual frangible cells 50.

Figure 5:
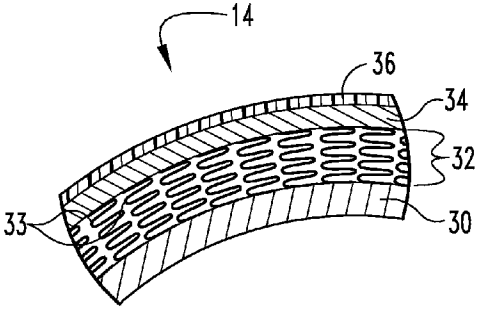
FIG. 5 is a second enlarged view of a cutaway section of a second alternate embodiment of FIG. 3.

Alternately, the impact absorbing/attenuating layer 32 may include a plurality of springs 33 (see FIG. 5), a fluidic layer connected to a hydraulic reservoir, or the like.

Typically, a plurality of cover plates 60 are lockingly connected to the generally convex panel 14. The cover plates 60 are positioned to prevent access to fasteners 62, such as bolts or the like, extending through the generally convex panel 14 and through the apertures 20 in the flange 12 to secure the system 10 to the exterior of a building. The cover plates 60 are operationally connected to the generally convex panel 14, such as by pins, hinges, or the like, and lockingly engage the generally convex panel 14, such as by an internally disposed key-operated bolt lock, external padlocks, or the like, to prevent unauthorized access to the fasteners. The fasteners 62 typically extend no more than partway through the generally convex panel 14. In other embodiments, the fasteners 62 extend from the exterior wall of the structure and through the apertures 20 to engage the flange 12 and, alternately, into the cover member 14. In this embodiment, no cover plates 60 are required, since there is no exterior access to the fasteners 62.

Figure 7B:
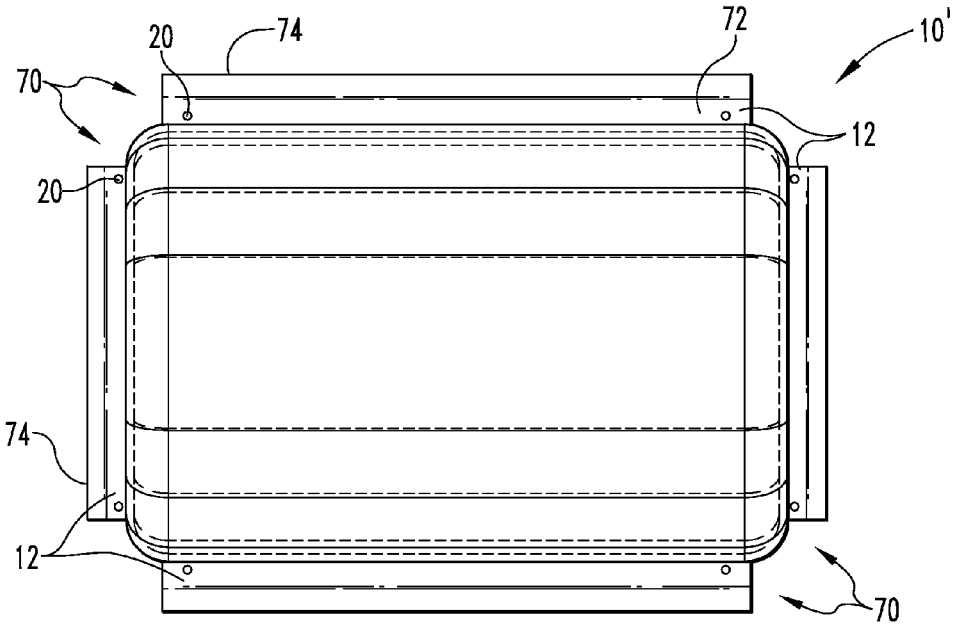
FIG. 7B is a top plan view of the embodiment of FIG. 7A.
Figure 7C:
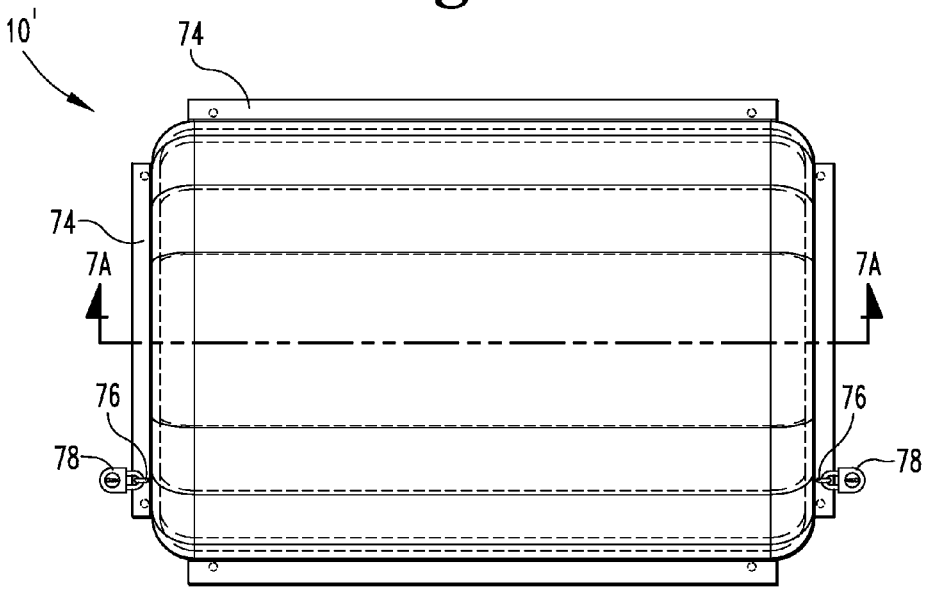
FIG. 7C is a top plan view of the embodiment of FIG. 7B with the security member engaged.

FIGS. 7A-7C illustrate another alternate embodiment of the present invention, a system 10' having a flange portion 12 extending beyond the borders of the generally convex structural member 14. The flange portion 12 is still connected to the generally convex structural member 14, and includes apertures 20 through which fasteners 62 extend to connect the system to the exterior wall of a structure for covering and protecting a window. A seal member 24 may be positioned between the flange portion 12 and the building exterior if desired.

The system 10' may optionally include a security member 70 for blocking access to engaged fasteners 62. In this embodiment, security member 70 is a thin flat structural portion shaped generally like the flange portion 12 and having apertures matching those of the flange portion. The security member 70 further includes a plurality of foldable tabs 74 for folding over and covering the flange portion 12 once the fasteners 62 are engaged to the structure therethrough. In this embodiment, the tabs 74 fold over each other, such that the first folded tab 74 is held in place by the second and third folded tabs 74, which are held in place by the fourth folded tab 74. Adjacent tabs 74 also include rings or slots 76 for insertion of a locking member 78, such as a hasp or a padlock.

Figure 8:
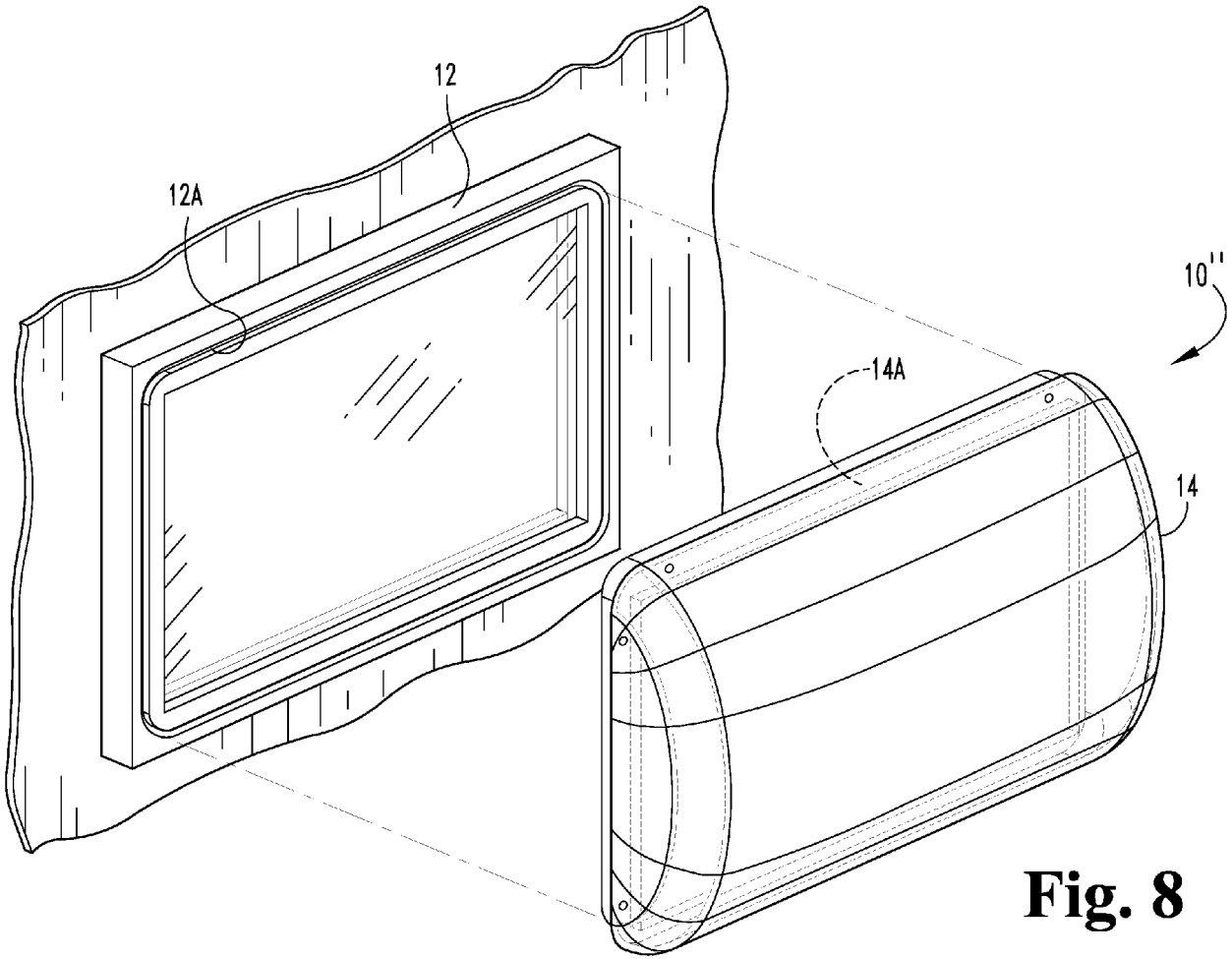
FIG. 8 is a perspective view of a third alternate embodiment of the present invention.

FIG. 8 illustrates another embodiment of the present novel technology, a convex window covering system 10" similar to that of FIG. 1 above and including a generally rectangular flange portion 12 connected to a generally convex structural member (or panel or shell) 14. In this embodiment, the flange portion 12 includes a trough 12A formed therein, and the shell portion 14 includes a pliable seal portion 14A connected thereto and positioned to matably fill trough portion 12A when the shell member 14 is connected to the flange portion 12.

Figure 9:
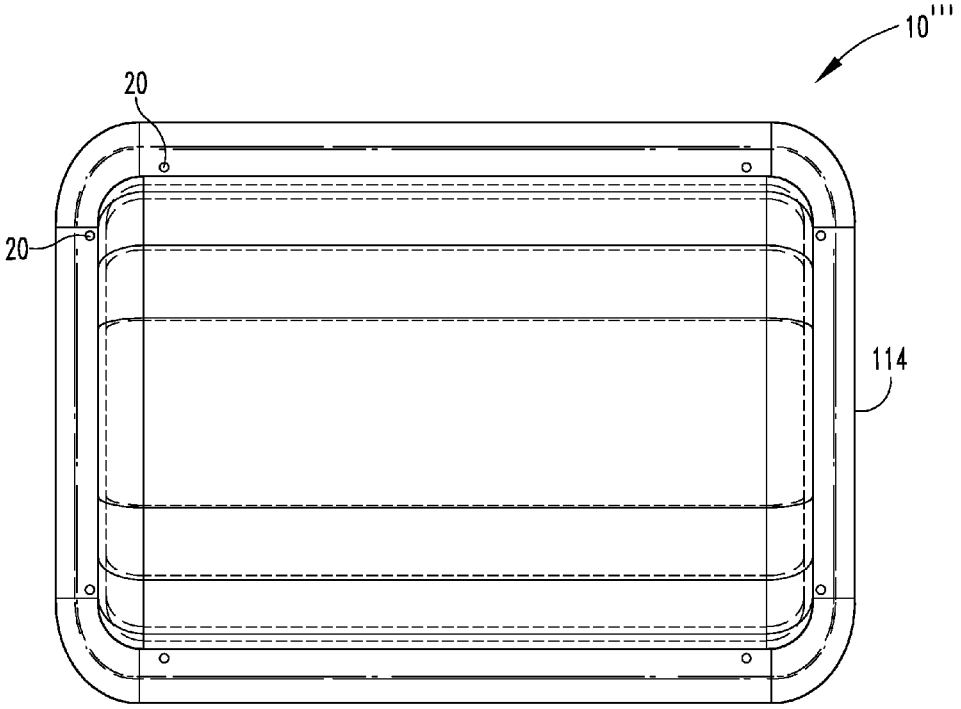
FIG. 9 is a top plan view of a fourth alternate embodiment of the present invention.
Figure 10:
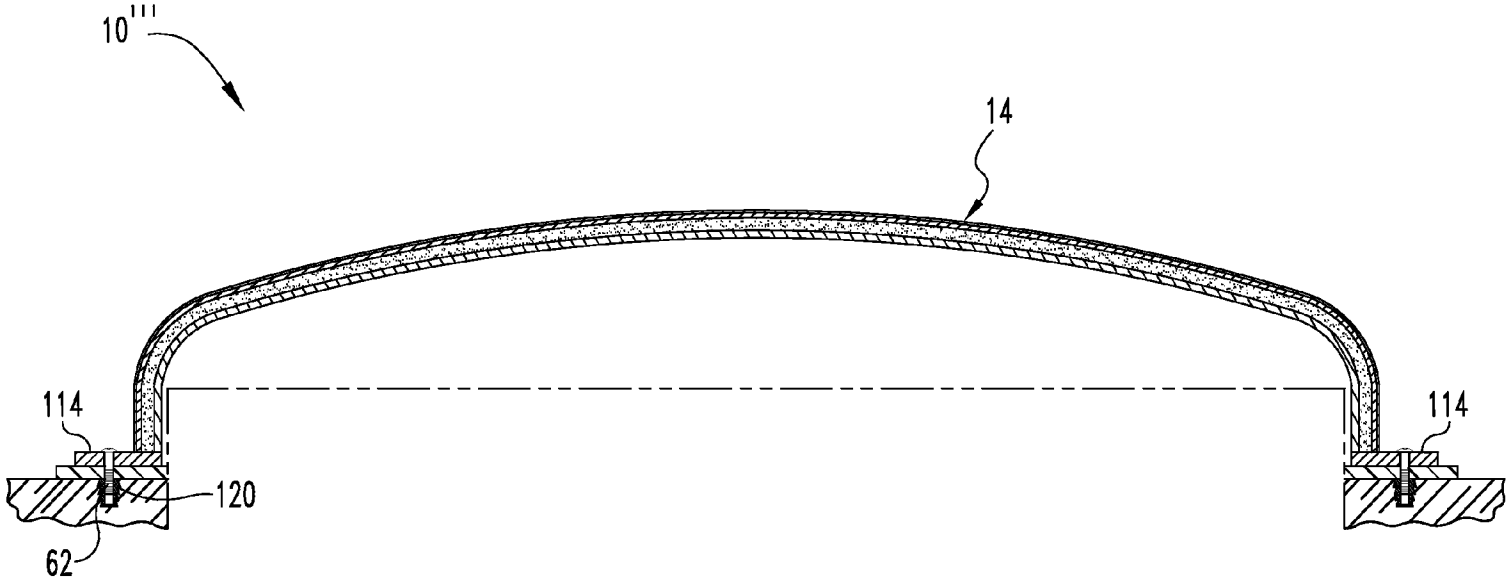
FIG. 10 is a side sectional view of the embodiment of FIG. 9.

FIGS. 9 and 10 illustrate still another embodiment of the present novel technology, a window covering system 10''' similar to those of the previous embodiments, and including a shell portion 14 having a generally flat peripheral flange portion 114 with a plurality of apertures 20 formed therethrough. A plurality of permanent screw anchors 120 are positioned in the frame around the window or like structural feature over which the shell portion 14 is to be replacably removably mounted. Fasteners 62 are then inserted through the apertures 20 and removably connected to the anchors 120, such that the shell portion 14 may be repeatedly detached and reattached to the window or like feature without continually degrading the frame and/or surrounding structure.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

I claim:

1. A window covering assembly, comprising in combination:

a generally convex panel, further comprising:

a structural outer layer;

a structural inner layer; and an impact absorbing layer disposed between the structural outer layer and the structural inner layer;

a flange connected to the generally convex panel and having a plurality of apertures formed therethrough;

a plurality of fasteners for extending through the apertures and at least partially through the generally convex panel; and a plurality of cover plates lockingly connected to the generally convex panel;

wherein the fasteners are bolts;

wherein the fasteners extend through the generally convex panel; and wherein each respective bolt is covered by one of the cover plates.

2. The assembly of claim 1:

wherein the structural outer layer is constructed from a material selected from the group including sheet metal, spun para-aramid synthetic fiber, fiber-reinforced composites, plastic and fiberglass; and wherein the impact-absorbing layer is selected from the group including open-celled foamed polymers, closed-cell foamed polymers, foamed glass, and rockwool.

3. The assembly of claim 1 wherein the impact-absorbing layer is selected from the group including a plurality of springs and hydraulic fluid.

4. The assembly of claim 1 and further comprising:

a security panel lockingly engagable to the flange; and wherein the impact absorbing layer further comprises a plurality of impact absorbing layers disposed between the structural outer layer and the structural inner layer; and wherein locking engagement of the security panel covers the plurality of apertures.

5. A window covering assembly, comprising in combination:

a generally convex panel defining a perimeter and further comprising:

a structural outer layer;

a structural inner layer; and an impact absorbing layer disposed between the structural outer layer and the structural inner layer;

a flange portion connected to the generally convex panel and having a plurality of apertures formed therethrough;

a plurality of fasteners for extending through the apertures for engaging a structure; and a security panel lockingly engagable to the flange portion;

wherein the flange portion and apertures extend beyond the perimeter; and wherein locking engagement of the security panel covers the plurality of apertures.

6. The window covering assembly of claim 5:

wherein the structural outer layer is constructed from a material selected from the group including sheet metal, spun para-aramid synthetic fiber, fiber-reinforced composites, plastic, fiberglass and combinations thereof; and wherein the impact-absorbing layer is selected from the group including open-celled foamed polymers, closed-cell foamed polymers, foamed glass, rockwool, and combinations thereof.

7. The assembly of claim 5 wherein the impact-absorbing layer is selected from the group including a plurality of springs, hydraulic fluid, and combinations thereof.

8. A protective window covering assembly, comprising in combination:

a generally convex panel defining a perimeter and further comprising:

a structural outer layer;

a structural inner layer; and an impact absorbing layer disposed between the structural outer layer and the structural inner layer;

a flange portion connected to the generally convex panel and having a plurality of apertures formed therethrough;

a plurality of fasteners for extending through the apertures and engaging a windowed structure; and a security member for partially extending between the flange portion and the structure, wherein the generally convex panel substantially covers a window;

wherein the security member is extendable around the flange portion and to cover at least some of the plurality of apertures; and wherein the security member is lockingly engaged over the apertures.

* * * * *